US011830662B2

(12) United States Patent
Kim et al.

(10) Patent No.: US 11,830,662 B2
(45) Date of Patent: Nov. 28, 2023

(54) COIL COMPONENT

(71) Applicant: SAMSUNG ELECTRO-MECHANICS CO., LTD., Suwon-si (KR)

(72) Inventors: Jae Hun Kim, Suwon-si (KR); Byeong Cheol Moon, Suwon-si (KR); Joung Gul Ryu, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 982 days.

(21) Appl. No.: 16/749,382

(22) Filed: Jan. 22, 2020

(65) Prior Publication Data

US 2021/0090784 A1 Mar. 25, 2021

(30) Foreign Application Priority Data

Sep. 25, 2019 (KR) ..... 10-2019-0118254

(51) Int. Cl.
*H01F 27/29* (2006.01)
*H01F 27/28* (2006.01)
(Continued)

(52) U.S. Cl.
CPC ..... *H01F 27/29* (2013.01); *H01F 17/0013* (2013.01); *H01F 27/2804* (2013.01);
(Continued)

(58) Field of Classification Search
CPC .. H01F 27/29; H01F 17/0013; H01F 27/2804; H01F 27/2828; H01F 27/292; H01F 41/041; H01F 2027/2809
See application file for complete search history.

(56) References Cited

U.S. PATENT DOCUMENTS

2013/0320492 A1* 12/2013 Yang ..... H01F 17/0013 438/381
2015/0102891 A1* 4/2015 Yoon ..... H01F 27/2804 336/200
(Continued)

FOREIGN PATENT DOCUMENTS

KR 10-2014-0038780 A 3/2014
KR 10-2015-0114924 A 10/2015
(Continued)

*Primary Examiner* — Marlon T Fletcher
*Assistant Examiner* — Malcolm Barnes
(74) *Attorney, Agent, or Firm* — Morgan, Lewis & Bockius LLP

(57) ABSTRACT

A coil component includes a support substrate; first and second coil portions, respectively arranged on the support substrate; a body embedding the support substrate and the first and second coil portions therein; first and second lead-out portions, respectively connected to end portions of the first and second coil portions and exposed from one surface to be spaced apart from each other; and first and second connection portions, respectively connecting the end portions of the first and second coil portions to the first and second lead-out portions, wherein a line width of one end of each of the first and second connection portions connected to the respective end portion of the first and second coil portions is smaller than a line width of another end of each of the first and second connection portions connected to a respective one of the first and second lead-out portions.

18 Claims, 8 Drawing Sheets

(51) Int. Cl.
*H01F 41/04* (2006.01)
*H01F 17/00* (2006.01)

(52) U.S. Cl.
CPC ..... *H01F 27/2828* (2013.01); *H01F 27/292* (2013.01); *H01F 41/041* (2013.01); *H01F 2027/2809* (2013.01)

(56) References Cited

U.S. PATENT DOCUMENTS

| | | | | |
|---|---|---|---|---|
| 2016/0078986 | A1* | 3/2016 | Yoon | H01F 5/04 336/83 |
| 2016/0189840 | A1* | 6/2016 | Ahn | H01F 17/04 29/602.1 |
| 2017/0053732 | A1* | 2/2017 | Moon | H01F 17/04 |
| 2017/0098997 | A1* | 4/2017 | Hamada | G06F 1/3296 |
| 2017/0162317 | A1* | 6/2017 | Taniguchi | H01F 27/292 |
| 2018/0174727 | A1* | 6/2018 | Kim | H01F 17/0013 |
| 2018/0174736 | A1* | 6/2018 | Li | H01F 41/042 |
| 2018/0350506 | A1* | 12/2018 | Nakatsuji | H01F 27/292 |

FOREIGN PATENT DOCUMENTS

| | | | |
|---|---|---|---|
| KR | 10-1662209 | B1 | 10/2016 |
| KR | 10-2018-0072482 | A | 6/2018 |

* cited by examiner

II-II'

COIL COMPONENT

CROSS-REFERENCE TO RELATED APPLICATION

The present application claims the benefit of priority to Korean Patent Application No. 10-2019-0118254 filed on Sep. 25, 2019 in the Korean Intellectual Property Office, the entire disclosure of which is incorporated herein by reference.

BACKGROUND

1. Field

The present disclosure relates to a coil component.

2. Description of Related Art

An inductor, a coil component, is a representative passive electronic component used in electronic devices, together with a resistor and a capacitor.

As electronic devices become more and more efficient and smaller, coil components used for electronic devices have increased in number and have become smaller.

Therefore, the inductors have been rapidly switched to chips simultaneously capable of miniaturization and high-density automatic surface mounting. Further, a thin film type inductor, manufactured by plating upper and lower surfaces of a substrate to form a coil pattern, mixing magnetic powder particles and resins in upper and lower portions of the coil pattern to form a magnetic sheet, and stacking, pressing, and curing the magnetic sheet, is being developed.

However, as the chip size of the thin film type inductor also becomes smaller, the volume of the main body may be reduced. Therefore, the space for forming the coil in the main body may be also reduced, and the number of turns of the formed coil may be decreased.

If the area for forming the coil is reduced in this manner, it may become difficult to secure high capacity, and the width of the coil may become small, to increase the direct current (DC) and alternating current (AC) resistances and to decrease a quality factor (Q).

Therefore, even if the size of the component is reduced, it may be necessary to form the coil to occupy the largest possible area in the miniaturized main body, in order to realize an improvement in capacity and quality factor.

In addition, as a thin coil component is manufactured, there may be a problem in that connection reliability and structural rigidity between the conductor and the body may be deteriorated, when external force or the like is applied to a portion to which the coil and the external electrode are connected.

SUMMARY

An aspect of the present disclosure is to provide a coil component capable of realizing relatively high capacity by increasing an area in which the coil portion is formed within the coil component having the same size as the related prior art.

Another object of the present disclosure is to provide a coil component having enhanced connection reliability and structural rigidity in a portion to which a coil portion and an external electrode are connected.

According to an aspect of the present disclosure, a coil component includes a support substrate; a first coil portion and a second coil portion, respectively arranged on the support substrate; a body having a first surface and a second surface opposing each other in a thickness direction of the body, and embedding the support substrate and the first and second coil portions therein; a first lead-out portion and a second lead-out portion, respectively connected to end portions of the first and second coil portions and exposed from the first surface of the body to be spaced apart from each other; and a first connection portion and a second connection portion, respectively connecting the end portions of the first and second coil portions to the first and second lead-out portions. Each of the first and second coil portions has a constant line width ranging a respective end portion of the first and second coil portions. Each end portion of the first and second coil portions is disposed in a first-half portion of the body, based on a central portion of the body in the thickness direction. A line width of one end of each of the first and second connection portions connected to the respective end portion of the first and second coil portions is smaller than a line width of another end of each of the first and second connection portions connected to a respective one of the first and second lead-out portions.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
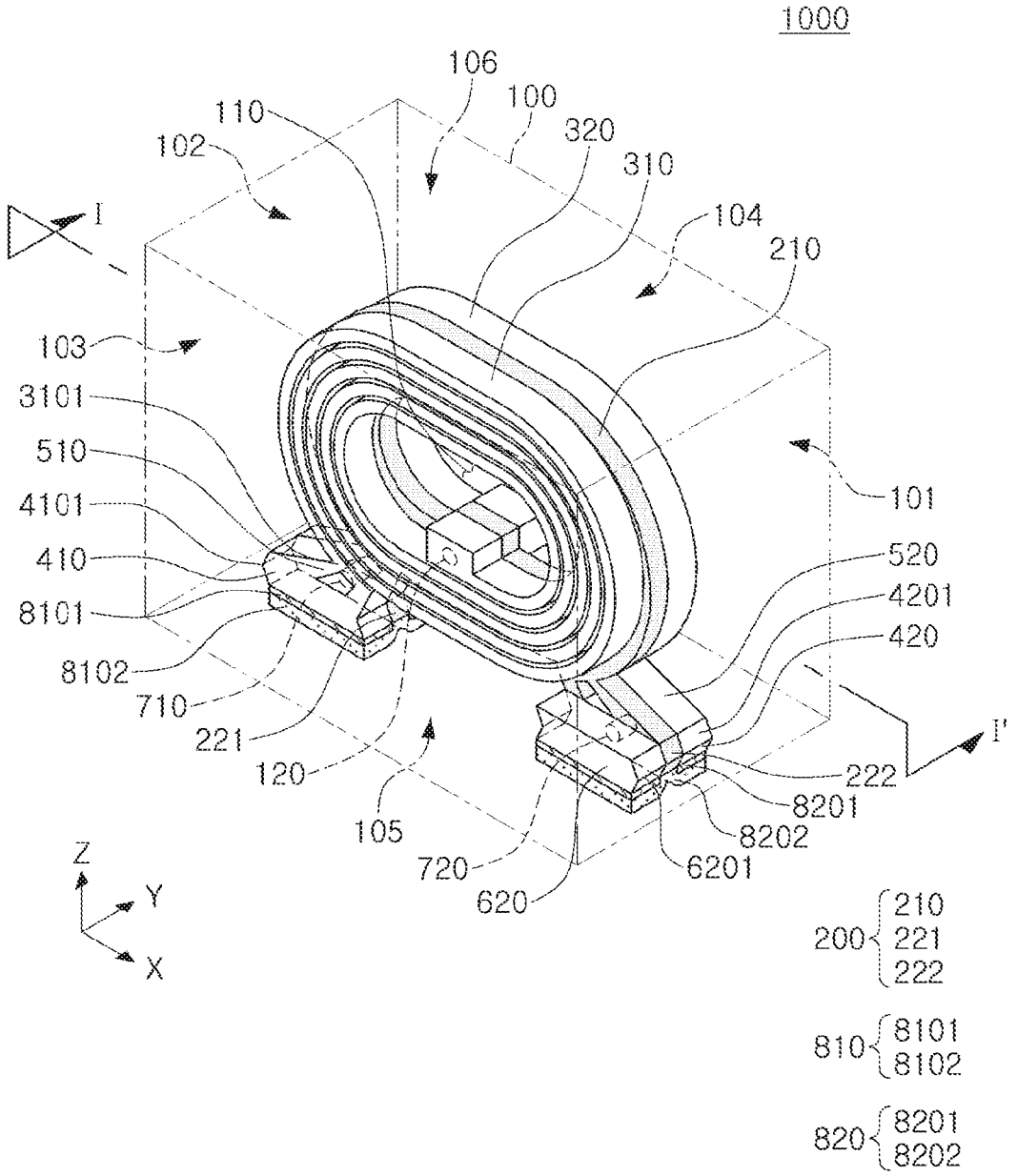
FIG. 1 is a view schematically illustrating a coil component according to a first embodiment of the present disclosure.

The terms used in the description of the present disclosure are used to describe a specific embodiment, and are not intended to limit the present disclosure. A singular term includes a plural form unless otherwise indicated. The terms "include," "comprise," "is configured to," etc. of the description of the present disclosure are used to indicate the presence of features, numbers, steps, operations, elements, parts, or combination thereof, and do not exclude the possibilities of combination or addition of one or more additional features, numbers, steps, operations, elements, parts, or combination thereof. Also, the terms "disposed on," "located on," and the like, may indicate that an element is located on or beneath an object, and does not necessarily mean that the element is located above the object with reference to a gravity direction.

The term "coupled to," "combined to," and the like, may not only indicate that elements are directly and physically in contact with each other, but also include the configuration in which another element is interposed between the elements such that the elements are also in contact with the other component.

Sizes and thicknesses of elements illustrated in the drawings are indicated as examples for ease of description, and the present disclosure are not limited thereto.

In the drawings, an X direction is a first direction or a length direction, a Y direction is a second direction or a width direction, a Z direction is a third direction or a thickness direction.

Hereinafter, a coil component according to an embodiment of the present disclosure will be described in detail with reference to the accompanying drawings. Referring to the accompanying drawings, the same or corresponding components may be denoted by the same reference numerals, and overlapped descriptions will be omitted.

In electronic devices, various types of electronic components may be used, and various types of coil components may be used between the electronic components to remove noise, or for other purposes.

In other words, in electronic devices, a coil component may be used as a power inductor, a high frequency (HF) inductor, a general bead, a high frequency (GHz) bead, a common mode filter, and the like.

First Embodiment

Figure 2:
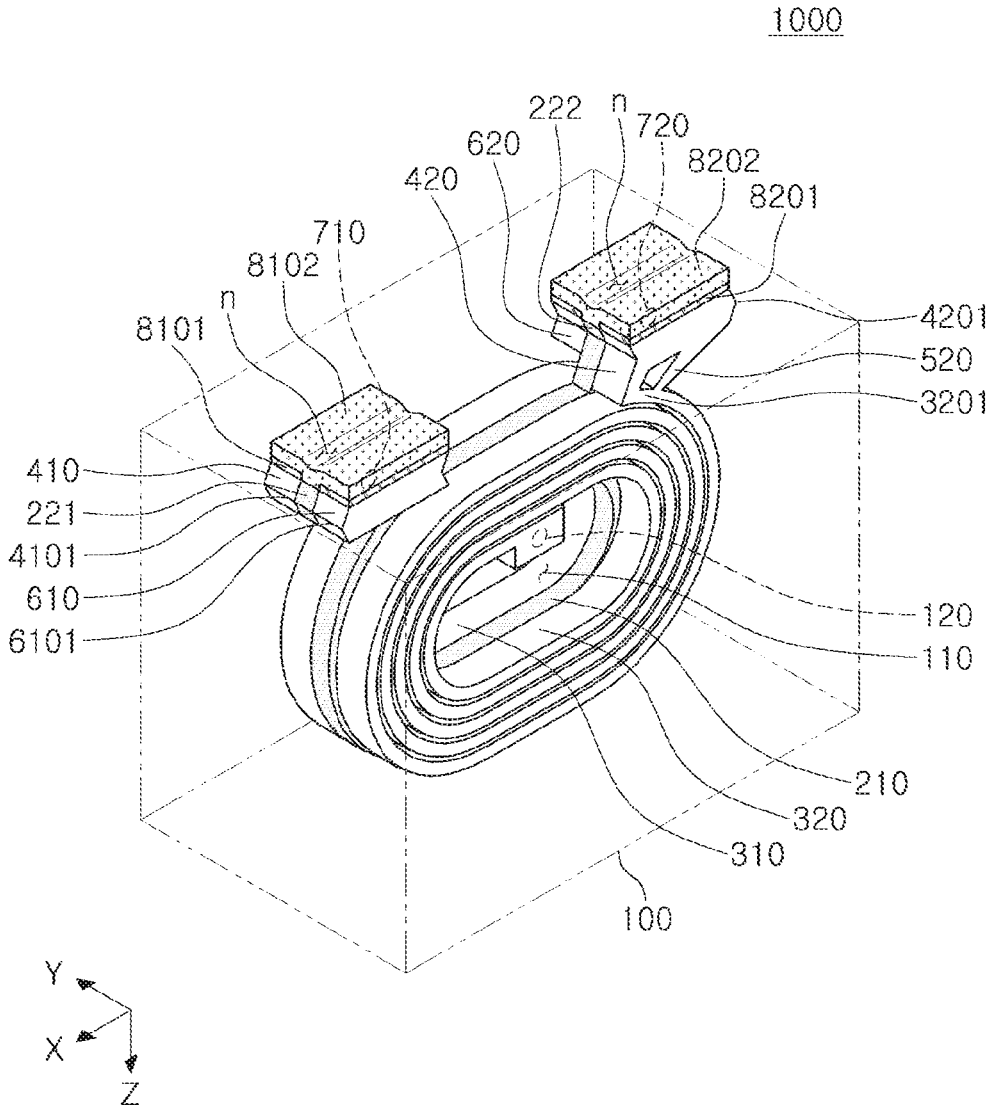
FIG. 2 is a view of the coil component of FIG. 1, when viewed from a bottom surface of the coil component.
Figure 3:
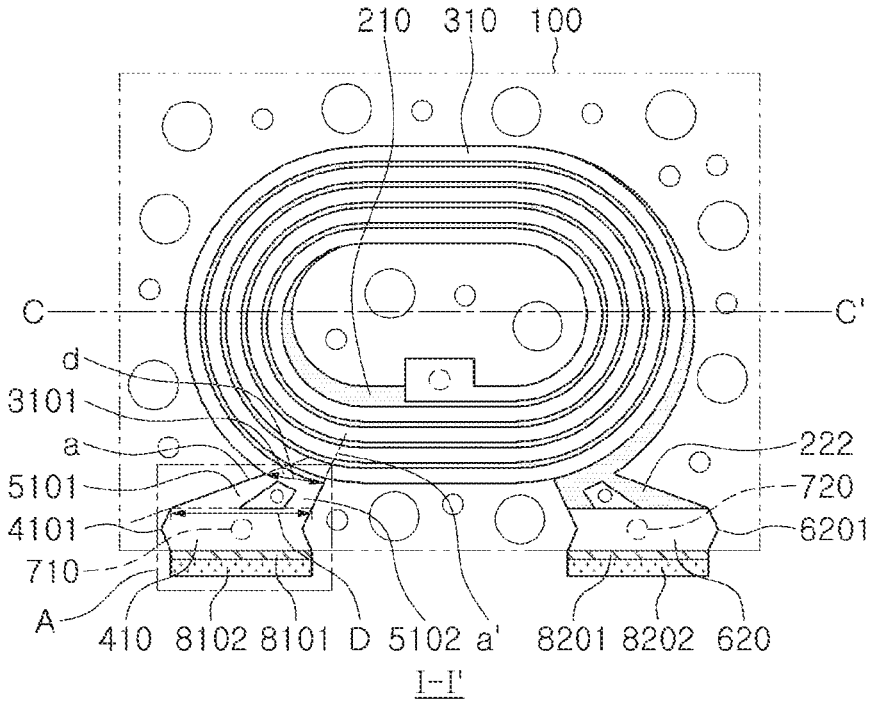
FIG. 3 is a cross-sectional view taken along line I-I' of FIG. 1.
Figure 4:
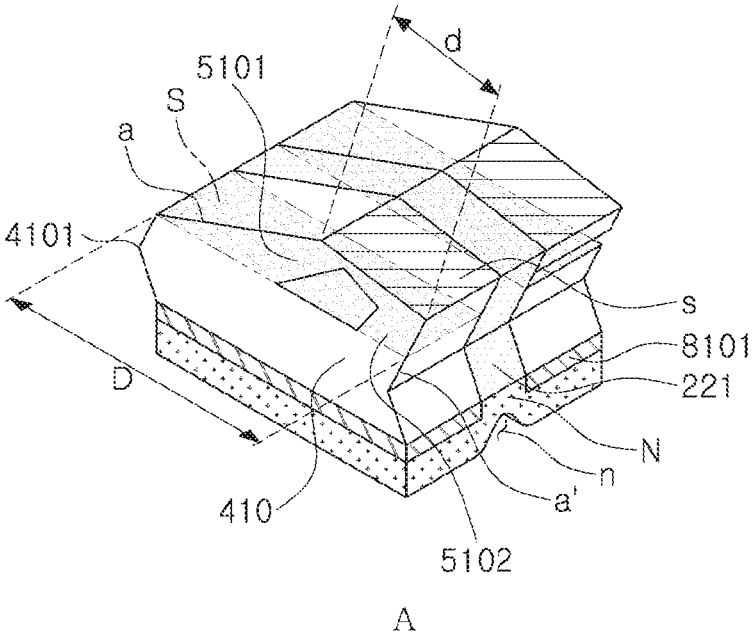
FIG. 4 is an enlarged view of portion A of FIG. 3.
Figure 5:
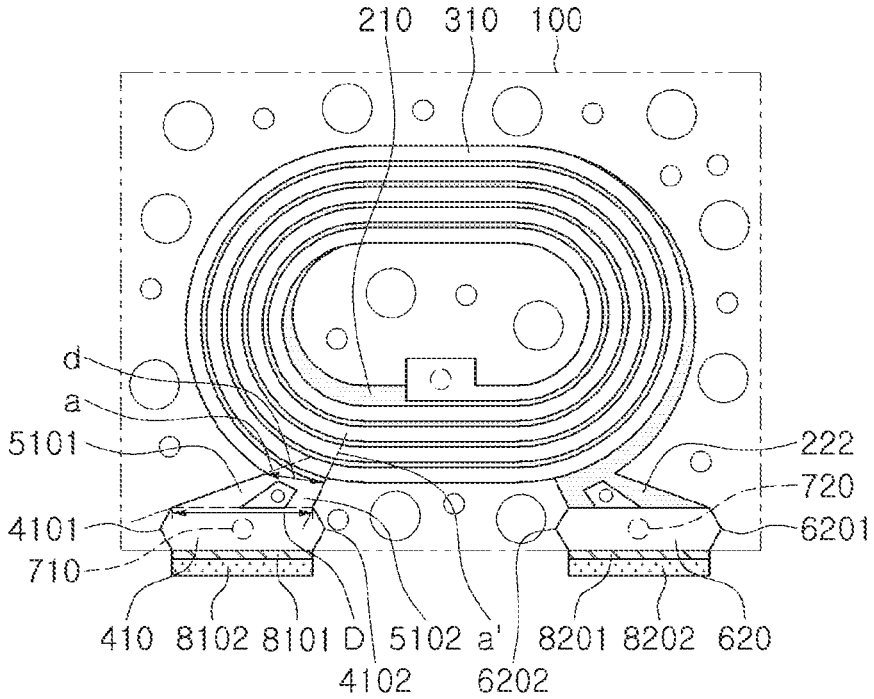
FIG. 5 is a cross-sectional view of a modification of a first embodiment of the present disclosure, taken along line I-I' of FIG. 1.
Figure 6:
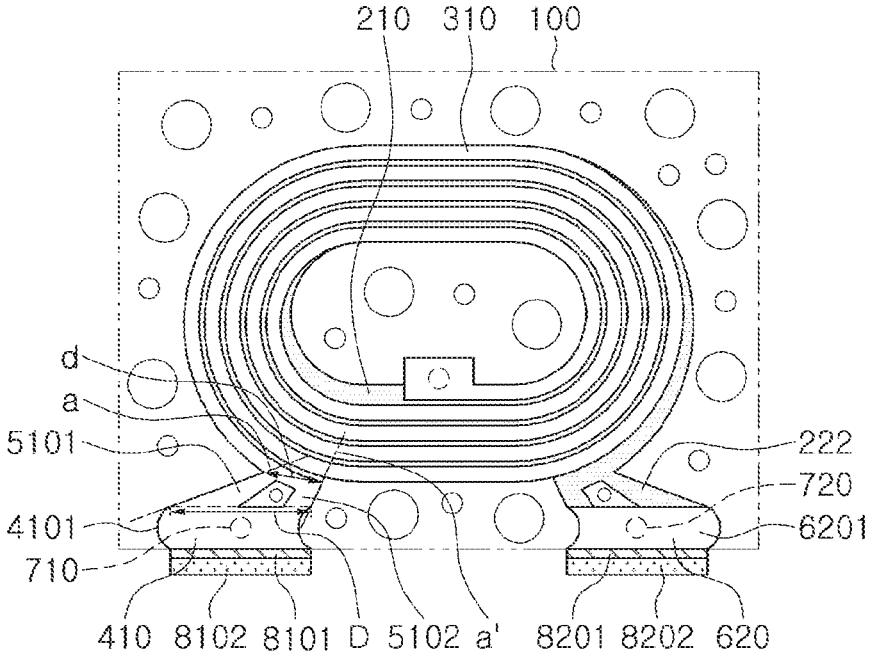
FIG. 6 is a cross-sectional view of another modification of a first embodiment of the present disclosure, taken along line I-I' of FIG. 1.

FIG. 1 is a view schematically illustrating a coil component according to a first embodiment of the present disclosure. FIG. 2 is a view of the coil component of FIG. 1, when viewed from a bottom surface of the coil component. FIG. 3 is a cross-sectional view taken along line I-I' of FIG. 1. FIG. 4 is an enlarged view of portion A of FIG. 3. FIG. 5 is a cross-sectional view of a modification of a first embodiment of the present disclosure, taken along line I-I' of FIG. 1. FIG. 6 is a cross-sectional view of another modification of a first embodiment of the present disclosure, taken along line I-I' of FIG. 1.

Referring to FIGS. 1 and 2, a coil component 1000 according to a first embodiment of the present disclosure may include a support substrate 200, first and second coil portions 310 and 320, a body 100, first and second lead-out portions 410 and 420, and first and second connection portions 510 and 520, and may further include first and second external electrodes 810 and 820, first and second auxiliary lead-out portions 610 and 620, and first and second connection vias 710 and 720.

The support substrate 200 may be disposed inside the body 100 to be described later, and may support the first and second coil portions 310 and 320, and the first and second lead-out portions 410 and 420.

The support substrate 200 may be formed of an insulating material including a thermosetting insulating resin such as an epoxy resin, a thermoplastic insulating resin such as a polyimide, or a photosensitive insulating resin, or may be formed of an insulating material in which a reinforcing material such as a glass fiber or an inorganic filler is impregnated with such an insulating resin. For example, the support substrate 200 may be formed of an insulating material such as prepreg, Ajinomoto Build-up Film (ABF), FR-4, a bismaleimide triazine (BT) film, a photoimageable dielectric (PID) film, and the like, but are not limited thereto.

As the inorganic filler, one or more selected from a group consisting of silica ($SiO_2$), alumina ($Al_2O_3$), silicon carbide (SiC), barium sulfate ($BaSO_4$), talc, mud, a mica powder, aluminium hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the support substrate 200 is formed of an insulating material including a reinforcing material, the support substrate 200 may provide more excellent rigidity. When the support substrate 200 is formed of an insulating material not containing glass fibers, the support substrate 200 may be advantageous in reducing an overall thickness of the first and second coil portions 310 and 320.

A central portion of the support substrate 200 may be passed through to form a through-hole (not illustrated), and the through-hole (not illustrated) may be filled with a magnetic material of the body 100, to be described later, to form a core portion 110. As such, the core portion 110 filled with the magnetic material may be formed to improve performance of the inductor.

A support portion 210 may be a region of the support substrate 200 that may be disposed between the first and second coil portions 310 and 320, to be described later, to support the first and second coil portions 310 and 320.

First and second end portions 221 and 222 may extend from the support portion 210 to support the first and second lead-out portions 410 and 420 and the first and second auxiliary lead-out portions 610 and 620, to be described later, in the support substrate 200. In particular, the first end portion 221 may be disposed between the first lead-out portion 410 and the first auxiliary lead-out portion 610 to support the first lead-out portion 410 and the first auxiliary lead-out portion 610. The second end portion 222 may be disposed between the second lead-out portion 420 and the second auxiliary lead-out portion 620 to support the second lead-out portion 420 and the second auxiliary lead-out portion 620.

The first and second end portions 221 and 222 may be exposed from a fifth surface 105 of the body 100 to be spaced apart from each other.

The first and second coil portions 310 and 320 may be arranged on at least one surface of the support substrate 200 to express characteristics of the coil component. For example, when the coil component 1000 of this embodiment is used as a power inductor, the first and second coil portions 310 and 320 may store an electric field as a magnetic field to maintain the output voltage to stabilize a power supply of the electronic device.

Referring to FIGS. 1 and 2, the first and second coil portions 310 and 320 may be respectively arranged on both surfaces of the support substrate 200 facing each other. The first coil portion 310 may be disposed on one surface of the support substrate 200 to face the second coil portion 320 disposed on the other surface of the support substrate 200. The first and second coil portions 310 and 320 may be electrically connected to each other by a via electrode 120 passing through the support substrate 200. Each of the first coil portion 310 and the second coil portion 320 may have a planar spiral shape in which at least one turn is formed about the core portion 110. For example, the first coil portion 310 may form at least one turn about the core portion 110 on the one surface of the support substrate 200.

According to an embodiment of the present disclosure, the first and second coil portions 310 and 320 may be formed in an upright position with respect to the fifth surface 105 or a sixth surface 106 of the body 100.

The formation in the upright position with respect to the fifth surface 105 or the sixth surface 106 of the body 100 refers that surfaces of the first and second coil portions 310 and 320, contacting the support substrate 200, are formed to be perpendicular or approximately perpendicular to the fifth surface 105 or the sixth surface 106 of the body 100, as illustrated in FIG. 1. For example, the first and second coil portions 310 and 320 and the fifth surface 105 or the sixth surface 106 of the body 100 may be formed in an upright position at an angle of 80° to 100°.

The first and second coil portions 310 and 320 may be formed to be parallel to a third surface 103 and a fourth surface 104 of the body 100. For example, surfaces of the first and second coil portions 310 and 320 contacting the support substrate 200 may be parallel to the third surface 103 and the fourth surface 104 of the body 100.

Since the coil component 1000 is reduced to a size of 1608 or 1006, or less, the body 100 having a thickness thereof greater than a width thereof may be formed, and a cross-sectional area of the body 100 in an X-Z-direction may become larger than a cross-sectional area of the body 100 in an XY-direction. As the first and second coil portions 310 and 320 are formed in the upright position with respect to the fifth surface 105 or the sixth surface 106 of the body 100, an area in which the first and second coil portions 310 and 320 are formed may increase. As an area in which the first and second coil portions 310 and 320 are formed is larger, inductance (L) and quality factor (Q) may be improved.

Referring to FIG. 3, each of the first and second coil portions 310 and 320 has a constant line width ranging end portion 3101 or 3201 of each of the first and second coil portions. The end portions 3101 and 3201 of the first and second coil portions may arranged in a lower portion (e.g., a first-half portion) of the body 100, based on a central portion of the body 100 in a thickness direction Z. For example, the end portions 3101 and 3201 of the first and second coil portions may be arranged in a lower portion of the body 100, based on a center line C-C' passing through a central portion of the body 100 in a thickness direction Z. The number of turns of the first and second coil portions 310 and 320 in this case may increase, as compared to a case in which the end portions 3101 and 3201 of the first and second coil portions are located on the center line C-C'.

The body 100 may form an exterior of the coil component 1000 according to this embodiment, and may embed the support substrate 200, and the first and second coil portions 310 and 320 therein.

The body 100 may be formed to have a hexahedral shape overall.

The body 100 may include a first surface 101 and a second surface 102 facing each other in a length direction X, a third surface 103 and a fourth surface 104 facing each other in a width direction Y, and a fifth surface 105 and a sixth surface 106 facing each other in a thickness direction Z. Hereinafter, one side surface and the other side surface of the body 100 may refer to the first surface 101 and the second surface 102 of the body, respectively, and one end surface and the other end surface of the body 100 may refer to the third surface 103 and the fourth surface 104 of the body, respectively. Further, one surface and the other surface of the body 100 may refer to the fifth surface 105 and the sixth surface 106 of the body 100, respectively.

The body 100 may be formed such that the coil component 1000 according to this embodiment in which the first and second external electrodes 810 and 820, to be described later, are formed has a length of 1.0 mm, a width of 0.5 mm, and a thickness of 0.8 mm, but is not limited thereto. Since the numerical values described above may be merely design values that do not reflect process errors and the like, they should be considered to fall within the scope of the present disclosure to the extent to which ranges may be recognized as the process errors.

The body 100 may include a magnetic material and a resin. As a result, the body 100 may be magnetic. The body 100 may be formed by stacking one or more magnetic composite sheets including a resin and a magnetic material dispersed in the resin. However, the body 100 may have a structure other than the structure in which the magnetic material may be dispersed in the resin. For example, the body 100 may be made of a magnetic material such as ferrite.

The magnetic material may be a ferrite powder particle or a metal magnetic powder particle. Examples of the ferrite powder particle may include at least one or more of spinel type ferrites such as Mg—Zn-based ferrite, Mn—Zn-based ferrite, Mn—Mg-based ferrite, Cu—Zn-based ferrite, Mg—Mn—Sr-based ferrite, Ni—Zn-based ferrite, and the like, hexagonal ferrites such as Ba—Zn-based ferrite, Ba—Mg-based ferrite, Ba—Ni-based ferrite, Ba—Co-based ferrite, Ba—Ni—Co-based ferrite, and the like, garnet type ferrites such as Y-based ferrite, and the like, and Li-based ferrites. The metal magnetic powder particle included in the body 100 may include at least one of iron (Fe), silicon (Si), chromium (Cr), cobalt (Co), molybdenum (Mo), aluminum (Al), niobium (Nb), copper (Cu), and nickel (Ni), and alloys thereof. For example, the metal magnetic powder particle may be at least one or more of a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, and a Fe—Cr—Al-based alloy powder. In this case, the metallic magnetic powder particle may be amorphous or crystalline. For example, the metal magnetic powder particle may be a Fe—Si—B—Cr-based amorphous alloy powder particle, but is not limited thereto. The ferrite powder particle and the metal magnetic powder particle may have an average diameter of about 0.1 μm to 30 μm, respectively, but are not limited thereto.

The body 100 may include two or more types of magnetic materials dispersed in the insulating resin. In this case, the term "different types of magnetic materials" means that magnetic materials dispersed in a resin are distinguished from each other by at least one of an average diameter, a composition, a crystallinity, and a shape. The insulating resin may include an epoxy, a polyimide, a liquid crystal polymer, or the like, in a singular or combined form, but is not limited thereto.

The first and second lead-out portions 410 and 420 may be connected to the end portions 3101 and 3201 of the first and second coil portions, respectively, and may be exposed from the one surface 105 of the body 100 to be spaced apart from each other.

Referring to FIG. 1, the end portion 3101 of the first coil portion formed on one surface of the support substrate 200 may extend to form the first lead-out portion 410, and the first lead-out portion 410 may be exposed from the one surface 105 of the body 100. In addition, the end portion 3201 of the second coil portion may extend to the other surface of the support substrate 200, facing the one surface of the support substrate 200, to form the second lead-out portion 420, and the second lead-out portion 420 may be exposed from the one surface 105 of the body 100.

Referring to FIGS. 1 and 2, the first and second external electrodes 810 and 820 and the first and second coil portions 310 and 320 may be connected to each other, respectively, by the first and second lead-out portions 410 and 420 arranged in the body 100.

The first and second lead-out portions 410 and 420 may include at least one of anchor portions 4101 and 4201 extending in a thickness direction (e.g., Z direction) of the body 100. The anchor portions 4101 and 4201 may include at least one edge.

Referring to FIGS. 1 to 2, the anchor portion 4101 included in the first lead-out portion 410 and the anchor portion 4201 included in the second lead-out portion 420 may be included.

The anchor portions 4101 and 4201 may be arranged in the first and second lead-out portions 610 and 620 to be inserted into the body 100, respectively, to reinforce fixation strength between the first and second lead-out portions 610 and 620 and the body 100. For example, when external force acts on the first and second lead-out portions 410 and 420 through the anchor portions 4101 and 4201 inserted into the body 100, the connection reliability between the first and second lead-out portions 410 and 420 and the body 100 may be improved.

As illustrated in FIGS. 1 and 2, the first and second auxiliary lead-out portions 610 and 620 may be arranged to correspond to the first and second lead-out portions 410 and 420 on both surfaces of the support substrate 200. In particular, the first auxiliary lead-out portion 610 may be disposed on the other surface of the first end portion 221 of the support substrate 200 to correspond to the first lead-out portion 410, and may be spaced apart from the second coil portion 320. The second auxiliary lead-out portion 620 may be disposed on one surface of the second end portion 222 of the support substrate 200 to correspond to the second lead-out portion 420, and may be spaced apart from the first coil portion 310.

The first and second auxiliary lead-out portions 610 and 620 may be electrically connected to the first and second lead-out portions 410 and 420 by the first and second connection vias 710 and 720 to be described later, respectively, and may be directly connected to the first and second external electrodes 810 and 820, respectively. Since the first and second auxiliary lead-out portions 610 and 620 are directly connected to the first and second external electrodes 810 and 820, respectively, fixation strength between the first and second external electrodes 810 and 820 and the body 100 may be improved. Since the body 100 includes an insulating resin and a magnetic metal material, and the first and second external electrodes 810 and 820 include conductive metals, thus being made of different materials, they may be not mixed with each other. Therefore, the first and second auxiliary lead-out portions 610 and 620 may be formed in the body 100 and exposed from the body 100 externally, to additionally connect the first and second external electrodes 810 and 820 and the first and second auxiliary lead-out portions 610 and 620. Since the connection between the first and second auxiliary lead-out portions 610 and 620 and the first and second external electrodes 810 and 820 is a metal-metal junction, bonding force of the connection may be stronger than bonding force between the body 100 and the first and second external electrodes 810 and 820. Therefore, fixation strength of the first and second external electrodes 810 and 820 with respect to the body 100 may be improved.

The first and second connection portions 510 and 520 may connect the end portions 3101 and 3201 of the first and second coil portions and the first and second lead-out portions 410 and 420, respectively. Referring to FIG. 3, the first connection portion 510 may be disposed on the one surface of the support substrate 200, and may connect the end portion 3101 of the first coil portion to the first lead-out portion 410. The second connection portion 520 may be disposed on the other surface of the support substrate 200, and may connect the end portion 3201 of the second coil portion to the second lead-out portion 420.

Referring to FIG. 3, as an example, the first connection portion 510 may include a plurality of connection conductors 5101 and 5102, respectively arranged on the one surface of the support substrate 200 to connect the first connection portions 410 and the first coil portion 310. Although not specifically illustrated, the second connection portion 520 disposed on the other surface of the support substrate 200 may also include a plurality of connection conductors, spaced apart from each other. The plurality of connection conductors 5101 and 5102 may be formed to be spaced apart from each other, and may further improve the bonding force of the body 100 and the coil portions 310 and 320 overall, and may improve inductance capacity, as the body 100 is filled in the internal spaces between the connection conductors, spaced apart from each other.

Referring to FIG. 3, a line width (d) of one end of each of the first and second connection portions 510 and 520 connected to each of the end portions 3101 and 3201 of the first and second coil portions may be narrower than a line width (D) of the other end of each of the first and second connection portions 510 and 520 connected to each of the first and second lead-out portions 410 and 420. A difference in line width may be formed by adjusting a slope (a) formed between an outermost surface of the first connection conductor 5101 and a surface in which the first lead-out portion 410 is exposed from the one surface 105 of the body 100, and a slope (a') formed between an outermost surface of the second connection conductor 5102 and a surface in which the second lead-out portion 420 is exposed from the one surface 105 of the body 100. For example, the adjustment of the slope (a) and the slope (a') may control distance and area of which the first and second lead-out portions 410 and 420 are exposed from the one surface 105 of the body 100. Therefore, a mounting area in the same component may be secured by adjusting a distance between the external electrodes 510 and 520 or controlling an area of the external electrodes 510 and 520 exposed from the one surface 105 of the body 100. In addition, referring to FIG. 3, a line width of each of the first and second connection portions 510 and 520 may increase, as each of the first and second connection portions 510 and 520 is closer to the first and second lead-out portions 410 and 420 from the end portions 3101 and 3201 of the first and second coil portions. The difference in line width may be formed by making the slope (a) less than the slope (a').

Each of the first and second connection portions 510 and 520 may have an outermost side surface (which includes the slope (a)) and an innermost side surface (which includes the slope (a')), with respect to the length direction (e.g., X direction) of the body 100. The innermost side surfaces of the first and second connection portions 510 and 520 may face each other, and the outermost side surfaces of the first and second connection portions 510 and 520 may respectively face the first and second surfaces 101 and 102 of the body 100.

A first acute angle defined by each outermost side surface of the first and second connection portions 510 and 520 and the one surface 105 of the body 100 may be smaller than a second acute angle defined by each innermost side surface of the first and second connection portions 510 and 520 and the one surface 105 of the body 100.

For example, referring to FIG. 4, a cross-sectional area (s) of one end surface of each of the first and second connection portions 510 and 520 connected to each of the end portions 3101 and 3201 of the first and second coil portions may be smaller than a cross-sectional area (S) of the other end surface of each of the first and second connection portions 510 and 520 connected to each of the first and second lead-out portions 410 and 420.

As a result, the end portions 3101 and 3201 of the first and second coil portions may be arranged in a lower portion of the body 100, the line width (d) of the one end of each of the connection portions 510 and 520 connected to each of the end portions 3101 and 3201 of the first and second coil portions may be formed to be narrower than the line width (D) of each of the other end of the first and second connection portions 510 and 520 connected to each of the first and second lead-out portions 410 and 420, to further increase the number of turns of the coil portions 310 and 320. For example, since the number of turns of the first coil portion 310 and the second coil portion 320 increases by ¼ turn, respectively, based on the support substrate 200, an area occupied by the coil portions 310 and 320 in the same component may increase.

For example, as illustrated in FIG. 3, the first connection portion 510 may be formed of the plurality of connection conductors 5101 and 5102 spaced apart from each other. In addition, as an internal space between the connection conductors 5101 and 5102 to be spaced apart from each other, is filled with the body 100, bonding force between the body 100 and the first and second coil portions 310 and 320 as a whole may be further improved, and a magnetic flux area thereof may increase. Although mainly described with reference to the first connection portion 510 for convenience, the description of the plurality of connection conductors spaced apart from each other may be applicable to the second connection portion 520 in the same manner.

Since the first coil portion 310, the first lead-out portion 410, the first auxiliary lead-out portion 610, the first connection portion 510, and the via electrode 120 may be integrally formed, no boundary may be formed therebetween. Since the above is only an example, the above-described configurations may not exclude a case in which a boundary is formed in different operations from the scope of the present disclosure. Although the first coil portion 310 and the first lead-out portion 410 were described in this embodiment, for convenience, the same description as the above may be also applicable to the second auxiliary lead-out portion 620 and the second connection portion 520, as well as the second coil portion 320 and the second lead-out portion 420.

At least one of the first coil portion 310, the first lead-out portion 410, the first auxiliary lead-out portion 610, the first connection portion 510, and the via electrode 120 may include at least one conductive layer.

For example, when the first coil portion 310, the first lead-out portion 410, the first auxiliary lead-out portion 610, the first connection portion 510, and the via electrode 120 are formed on the one surface of the support substrate 200 by a plating process, each of the first coil portion 310, the first lead-out portion 410, the first auxiliary lead-out portion 610, the first connection portion 510, and the via electrode 120 may include a seed layer and an electroplating layer. The seed layer may be formed by a vapor deposition method such as an electroless plating process, a sputtering process, or the like. The seed layer may be generally formed to conform to a shape of the first coil portion 310. A thickness of the seed layer is not limited, but may be thinner than the plating layer. Next, a plating layer may be disposed on a seed layer. As a non-restrictive example, the plating layer may be formed using an electroplating process. Each of the seed layer and the electroplating layer may have a single-layer structure or a multilayer structure. The electroplating layer of the multilayer structure may be formed by a conformal film structure in which one electroplating layer is covered by the other electroplating layer, or may have a form in which the other electroplating layer is only stacked on one surface of the one electroplating layer.

The seed layers of the first coil portion 310, the first lead-out portion 410, the first auxiliary lead-out portion 610, the first connection portion 510, and the via electrode 120 may be integrally formed, no boundary may be formed therebetween, but are not limited thereto.

The seed layer and the plating layer of each of the first coil portion 310, the first lead-out portion 410, the first auxiliary lead-out portion 610, the first connection portion 510, and the via electrode 120 may be formed of a conductive material such as copper (Cu), aluminum (Al), silver (Ag), tin (Sn), gold (Au), nickel (Ni), lead (Pb), titanium (Ti), chromium (Cr), molybdenum (Mo), or alloys thereof, but are not limited thereto.

Referring to FIGS. 1 and 2, the first and second external electrodes 810 and 820 may be arranged on the one surface 105 of the body 100 to be spaced apart from each other, and may cover the first and second lead-out portions 410 and 420, respectively. The first external electrode 810 may be in contact with and connected to the first lead-out portion 410 and the first auxiliary lead-out portion 610, and the second external electrode 820 may be in contact with and connected to the second lead-out portion 420 and the second auxiliary lead-out portion 620.

When the coil component 1000 according to this embodiment is mounted on a printed circuit board, or the like, the first and second external electrodes 810 and 820 may electrically connect the coil component 1000 to the printed circuit board, or the like. For example, the coil component 1000 according to this embodiment may be mounted such that the fifth surface 105 of the body 100 faces an upper surface of the printed circuit board. In this case, since the first and second external electrodes 810 and 820 may be arranged on the fifth surface 105 of the body 100 to be spaced apart from each other, connection portions of the printed circuit board may be electrically connected.

The first and second external electrodes 810 and 820 may include at least one of a conductive resin layer and an electroplating layer. The conductive resin layer may be formed by printing a conductive paste on the surface of the body 100 and curing the conductive paste. The conductive paste may include any one or more conductive metals selected from the group consisting of copper (Cu), nickel (Ni), and silver (Ag), and a thermosetting resin. The electroplating layer may include any one or more selected from the group consisting of nickel (Ni), copper (Cu), and tin (Sn). In this embodiment, the first and second external electrodes 810 and 820 may include first layers 8101 and 8201 formed on the surface of the body 100 and in direct contact with the first and second lead-out portions 410 and 420 and the first and second auxiliary lead-out portions 610 and 620, and second layers 8102 and 8202 arranged on the first layers 8101 and 8201, respectively. For example, the first layers 8101 and 8201 may be nickel (Ni) plating layers, and the second layers 8102 and 8202 may be tin (Sn) plating layers, but are not limited thereto.

Referring to FIGS. 2 and 4, the first layers 8101 and 8201 may be not arranged on the first and second end portions 221 and 222 exposed from an external surface of the body 100. For example, a spaced portion N may be formed in a central portion between each of the first layers 8101 and 8201 and each of the first and second end portions 221 and 222. Since electrical connectivity between each of the first and second end portions 221 and 222 and each of the first and second lead-out portions 410 and 420 may be different from each other, each of the first layers 8101 and 8201 made of metal may be mainly plated on a surface of each of the first and second lead-out portions 410 and 420 and a surface of each of the first and second auxiliary lead-out portions 610 and 620. As a result, the first layers 8101 and 8201 arranged on each of the first and second lead-out portions 410 and 420 and each of the first and second auxiliary lead-out portions 610 and 620 may form the spaced portion N in a region corresponding to the first and second end portions 221 and 222.

The second layers 8102 and 8202 may be arranged along each of the first layers 8101 and 8201 to cover each of the first layers 8101 and 8201 and each of the first and second end portions 221 and 222. Since the second layers 8102 and 8202 also do not have strong bonding strength with the first and second end portions 221 and 222, a recessed portion n may be formed in a central portion of the second layers 8102 and 8202, as illustrated in FIGS. 2 and 4.

Referring to FIGS. 1 and 2, the first and second connection vias 710 and 720 may connect each of the first and second lead-out portions 410 and 420 to each of the first and second auxiliary lead-out portions 610 and 620. The first auxiliary lead-out portion 610 and the first lead-out portion 410 may be connected to each other by the first connection via 710 passing through the first end portion 221. The second auxiliary lead-out portion 620 and the second lead-out portion 420 may be connected to each other by the second connection via 720 passing through the second end portion 222.

In particular, referring to FIG. 3, the first connection via 710 may pass through the first lead-out portion 410 and the first auxiliary lead-out portion 610 to be disposed inside the body 100, and the second connection via 720 may pass through the second lead-out portion 420 and the second auxiliary lead-out portion 620 to be disposed inside the body 100. As a result, a cross-section of each of the first and second connection vias 710 and 720 arranged inside the body 100 may have a circular shape in the width direction Y of the body 100.

Modification of First Embodiment

FIG. 5 is a cross-sectional view of a modification of a first embodiment of the present disclosure, taken along line I-I' of FIG. 1.

A coil component 1000 according to this embodiment may have a difference in the number of anchor portions, compared to the coil component 1000 according to the first embodiment of the present disclosure. Therefore, only the number of anchor portions, different from the first embodiment of the present disclosure, will be described in describing this embodiment. The remaining configuration of this embodiment may be applied as is in the first embodiment of the present disclosure.

Referring to FIG. 5, anchor portions 4102 and 6202 may be additionally formed at both lower ends of each of the first lead-out portion 410 and the second auxiliary lead-out portion 620, and may be arranged inside the body 100. As a result, since the anchor portion inserted inside the body 100 may be further included, compared to those of the first embodiment, the connection reliability between the body 100 and each of the external electrodes 810 and 820 may be further improved.

Another Modification of First Embodiment

FIG. 6 is a cross-sectional view of another modification of a first embodiment of the present disclosure, taken along line I-I' of FIG. 1.

A coil component 1000 according to this embodiment may have a difference in shapes of anchor portions, compared to the coil component 1000 according to the first embodiment of the present disclosure. Therefore, only shapes of anchor portions, different from the first embodiment of the present disclosure, will be described in describing this embodiment. The remaining configuration of this embodiment may be applied as is in the first embodiment of the present disclosure.

Referring to FIG. 6, anchor portions 4101 and 6201 may include a curved shape. As a result, since stress concentration in a corner region may be reduced, compared to a case in which anchor portions include a polygonal corner, the connection reliability between the body 100 and each of the external electrodes 810 and 820 may be further improved.

Second Embodiment

Figure 7:
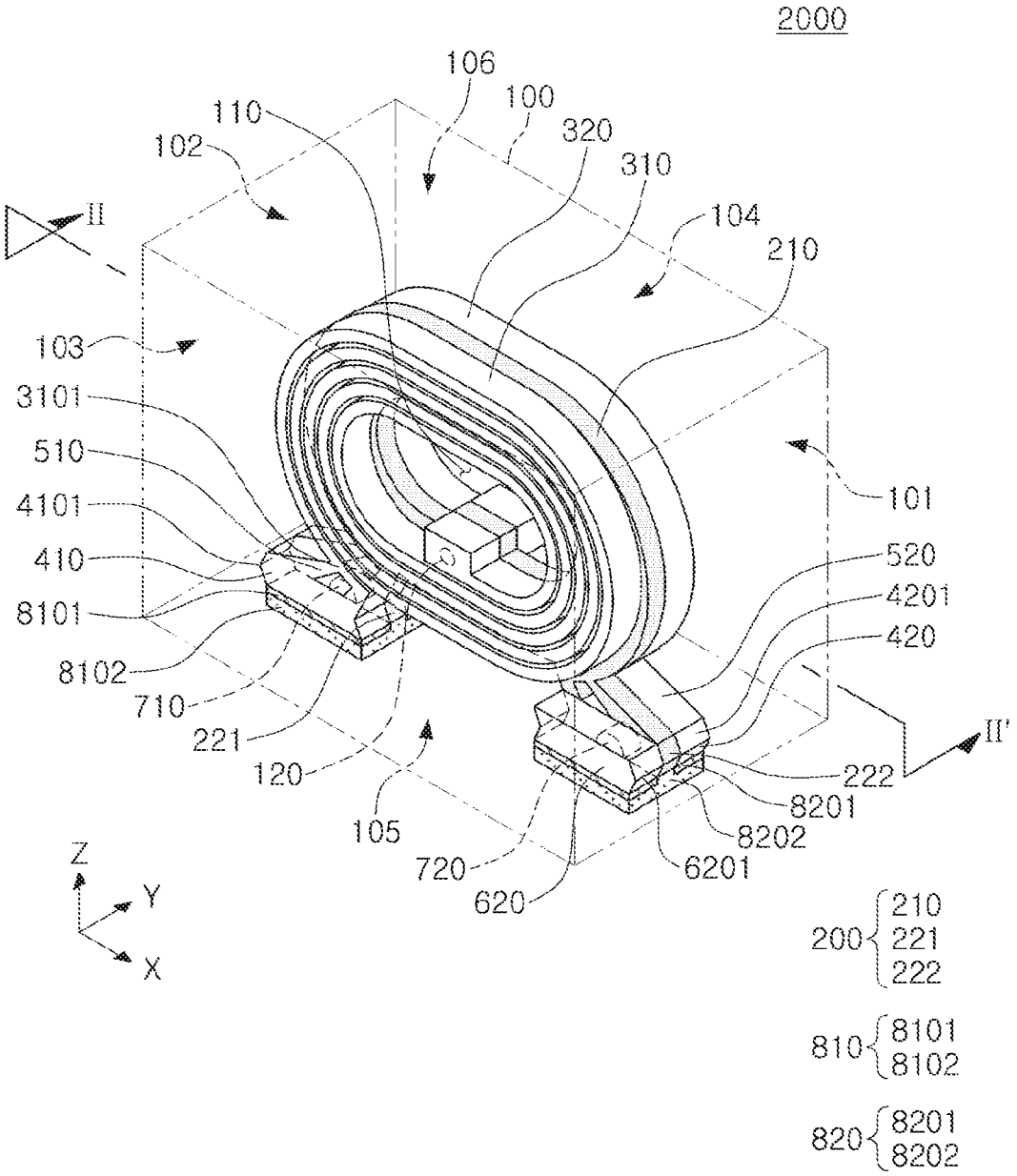
FIG. 7 is a view schematically illustrating a coil component according to a second embodiment of the present disclosure.
Figure 8:
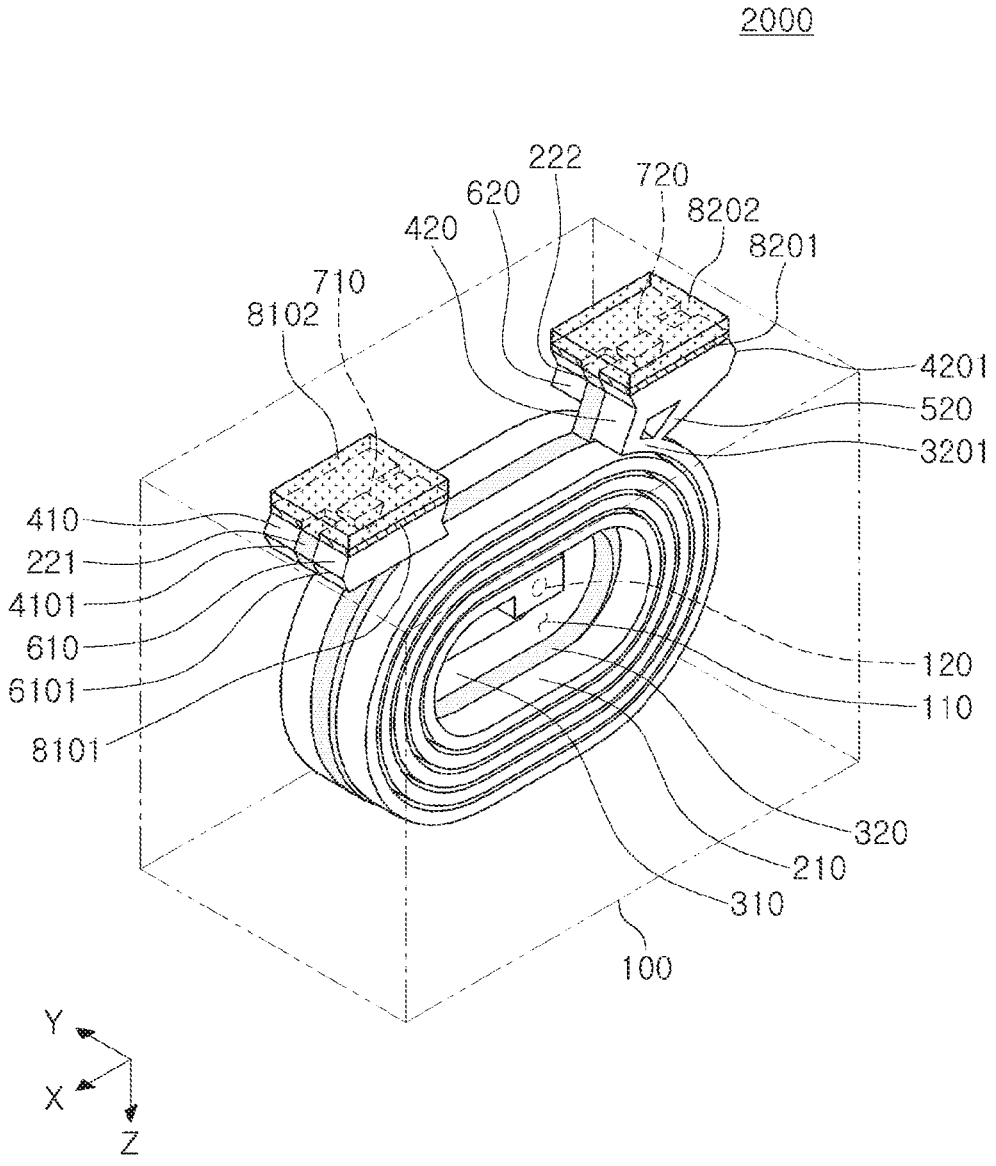
FIG. 8 is a view of the coil component of FIG. 7, when viewed from a bottom surface of the coil component.
Figure 9:
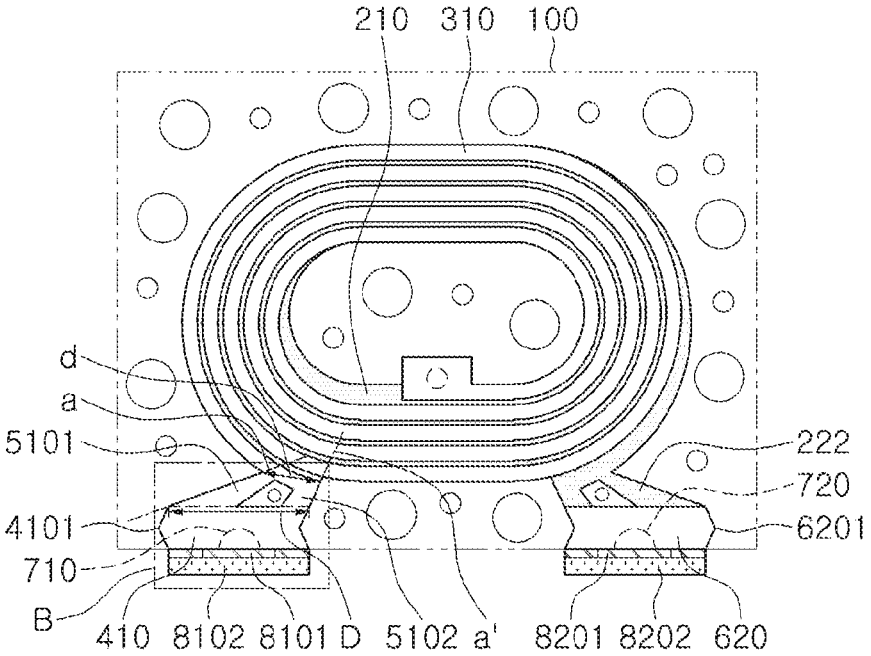
FIG. 9 is a cross-sectional view taken along line II-II' of FIG. 7.
Figure 10:
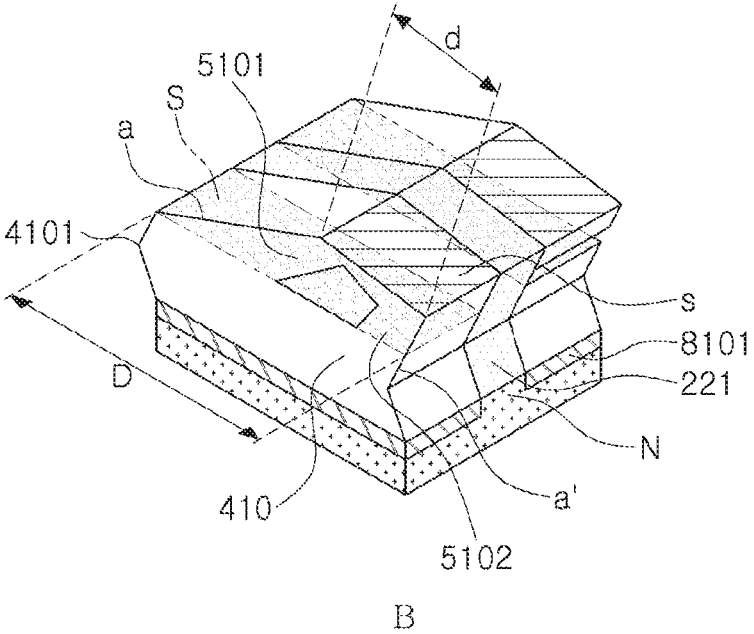
FIG. 10 is an enlarged view of portion B of FIG. 9.
Figure 11:
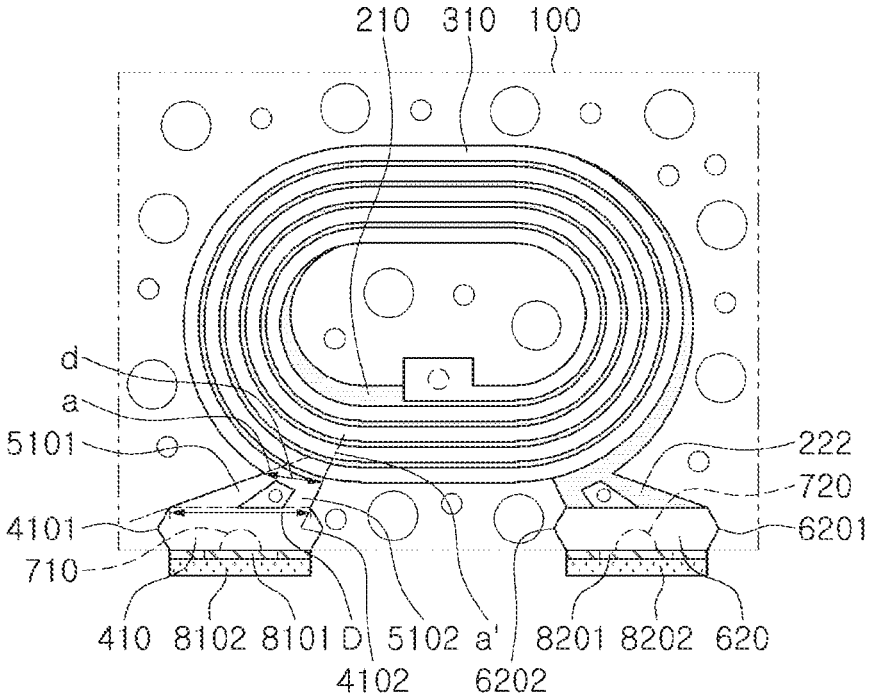
FIG. 11 is a cross-sectional view of a modification of a first embodiment of the present disclosure, taken along line II-II' of FIG. 7.
Figure 12:
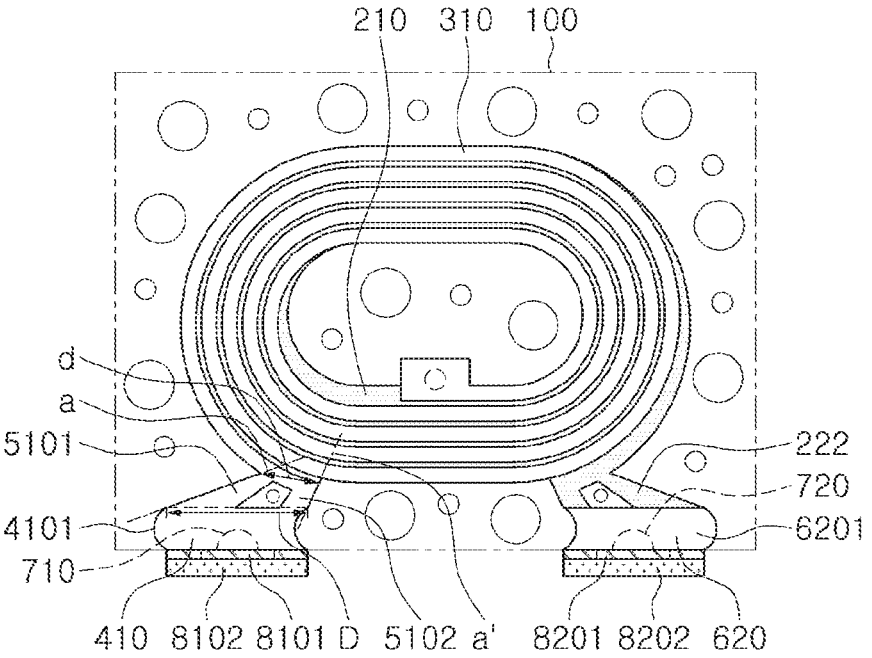
FIG. 12 is a cross-sectional view of another modification of a first embodiment of the present disclosure, taken along line II-II' of FIG. 7.

FIG. 7 is a view schematically illustrating a coil component according to a second embodiment of the present disclosure. FIG. 8 is a view of the coil component of FIG. 7, when viewed from a bottom surface of the coil component. FIG. 9 is a cross-sectional view taken along line II-II' of FIG. 7. FIG. 10 is an enlarged view of portion B of FIG. 9. FIG. 11 is a cross-sectional view of a modification of a first embodiment of the present disclosure, taken along line II-II' of FIG. 7. FIG. 12 is a cross-sectional view of another modification of a first embodiment of the present disclosure, taken along line II-II' of FIG. 7.

A coil component 2000 according to this embodiment may have a difference in view of shapes of first and second connection vias 710 and 720 and shapes of first and second external electrodes 810 and 820, compared to the coil component 1000 according to the first embodiment of the present disclosure. Therefore, only shapes of first and second connection vias 710 and 720 and shapes of first and second external electrodes 810 and 820, different from the first embodiment of the present disclosure, will be described in describing this embodiment. The remaining configuration of this embodiment may be applied as is in the first embodiment of the present disclosure.

Referring to FIGS. 7 and 8, the first connection via 710 may be disposed on a first end portion 221, and the second connection via 720 may be disposed on a second end portion 222. The second connection vias 710 and 720 may be exposed from a fifth surface 105 of a body 100 to be spaced apart from each other. In particular, referring to FIG. 9, the first connection via 710 may pass through a first lead-out portion 410 and a first auxiliary lead-out portion 610 to be disposed in a region of a first end portion 221 exposed from the fifth surface 105 of the body 100, and the second connection via 720 may pass through a second lead-out portion 420 and a second auxiliary lead-out portion 620 to be disposed in a region of a second end portion 222 exposed from the fifth surface 105 of the body 100. As a result, a cross-section of each of the first and second connection vias 710 and 720 arranged on each of the first and second end portions 221 and 222 may have a circular shape, from which a portion is removed, in the width direction Y of the body 100.

Referring to FIGS. 7 and 8, a first external electrode 810 covering the first lead-out portion 410 and the first connection via 710, and a second external electrode 820 covering the second lead-out portion 420 and the second connection via 720 may be further included. Referring to FIGS. 9 and 10, first layers 8101 and 8201 covering the first and second end portions 221 and 222 on which the first and second connection vias 710 and 720 are not arranged may form a spaced portion N, as in the first embodiment. A plating operation may be performed such that the first layers 8101 and 8201 are filled in the spaced portion N by adjusting a plating speed, intensity of current applied during the plating operation, plating concentration, and the like. For example, since the first and second connection vias 710 and 720 exposed from an external surface of the body 100 include a conductive material, the first layers 8101 and 8201 become easy to be plated on and filled in the first and second end portions 221 and 222.

Second layers 8102 and 8202 may be disposed on each of the first layers 8101 and 8201 to cover each of the first layers 8101 and 8201 and each of the first and second end portions 221 and 222. For example, referring to FIG. 10, in a different manner to the first embodiment, each of the second layers 8102 and 8202 may not include a recessed portion. In this embodiment, an area in which the first layers 8101 and 8201 are arranged may increase by an area in which the first and second connection vias 710 and 720 are exposed from the external surface of the body 100. As a result, a surface area on which the external electrodes 810 and 820 are arranged may further increase.

It may be intended that the invention not be limited by the foregoing embodiments and the accompanying drawings, but rather by the claims appended hereto.

Accordingly, various forms of substitution, modification, and alteration may be made by those skilled in the art without departing from the technical spirit of the present disclosure described in the claims, which may be also within the scope of the present disclosure.

According to the present disclosure, relatively high capacity may be realized by increasing an area in which the coil portion is formed within the coil component having the same size as the related prior art.

In addition, according to the present disclosure, it is possible to enhance the connection reliability and structural rigidity in a portion to which a coil portion and an external electrode are connected.

While exemplary embodiments have been illustrated and described above, it will be apparent to those skilled in the art that modifications and variations could be made without departing from the scope of the present disclosure as defined by the appended claims.

What is claimed is:

1. A coil component comprising:

a support substrate;

a first coil portion and a second coil portion, respectively arranged on the support substrate;

a body having a first surface and a second surface opposing each other in a thickness direction of the body, and embedding the support substrate and the first and second coil portions therein;

a first lead-out portion and a second lead-out portion, respectively connected to end portions of the first and second coil portions, the first and second lead-out portions being exposed from the first surface of the body to be spaced apart from each other; and a first connection portion and a second connection portion, respectively connecting the end portions of the first and second coil portions to the first and second lead-out portions, wherein each of the first and second coil portions has a constant line width ranging a respective end portion of the first and second coil portions, each end portion of the first and second coil portions is disposed in a first-half portion of the body, based on a central portion of the body in the thickness direction, a line width of one end of each of the first and second connection portions connected to the respective end portion of the first and second coil portions is smaller than a line width of another end of each of the first and second connection portions connected to a respective one of the first and second lead-out portions, and a line width of each of the first and second connection portions increases, as each of the first and second connection portions is closer to the respective one of the first and second lead-out portions from the respective end portion of each of the first and second coil portions.

2. The coil component according to claim 1, wherein the first and second lead-out portions comprise at least one anchor portion extending in a direction toward an inner side of the body.

3. The coil component according to claim 2, wherein the at least one anchor portion includes at least one edge.

4. The coil component according to claim 2, wherein the at least one anchor portion has a curved shape.

5. The coil component according to claim 1, wherein each of the first and second connection portions includes a plurality of connection conductors spaced apart from each other.

6. The coil component according to claim 1, wherein the support substrate comprises:

a support portion arranged between the first and second coil portions to support the first and second coil portions;

a first end portion supporting the first lead-out portion; and a second end portion supporting the second lead-out portion.

7. The coil component according to claim 6, wherein the first and second end portions are exposed from the first surface of the body to be spaced apart from each other.

8. The coil component according to claim 1, further comprising first and second external electrodes respectively covering the first and second lead-out portions.

9. A coil component comprising:

a support substrate;

a body embedding the support substrate and comprising a first surface and a second surface opposing each other in a thickness direction of the body;

a first coil portion and a second coil portion, respectively arranged on one surface and another surface of the support substrate, opposing each other;

a first lead-out portion and a second lead-out portion, respectively connected to end portions of the first and second coil portions, the first and second lead-out portions being exposed from the first surface of the body to be spaced apart from each other;

a first connection portion and a second connection portion, respectively connecting the end portions of the first and second coil portions to the first and second lead-out portions;

a first auxiliary lead-out portion disposed on the another surface of the support substrate and corresponding to the first lead-out portion on the one surface of the support substrate; and a second auxiliary lead-out portion disposed on the one surface of the support substrate and corresponding to the second lead-out portion on the another surface of the support substrate, wherein each of the first and second coil portions has a constant line width ranging a respective end portion of the first and second coil portions, each end portion of the first and second coil portions is disposed in a first-half portion of the body, based on a central portion of the body in the thickness direction, a cross-sectional area of one end of each of the first and second connection portions connected to the respective end portion of the first and second coil portions is smaller than a cross-sectional area of another end of each of the first and second connection portions connected to a respective one of the first and second lead-out portions, based on the thickness direction of the body.

10. The coil component according to claim 9, wherein the first and second lead-out portions comprise at least one anchor portion extending in a direction toward an inner side of the body.

11. The coil component according to claim 9, wherein the support substrate comprises:

a support portion arranged between the first and second coil portions;

a first end portion disposed between the first lead-out portion and the first auxiliary lead-out portion; and a second end portion disposed between the second lead-out portion and the second auxiliary lead-out portion.

12. The coil component according to claim 11, further comprising:

a first connection via connecting the first lead-out portion to the first auxiliary lead-out portion; and a second connection via connecting the second lead-out portion to the second auxiliary lead-out portion.

13. The coil component according to claim 12, wherein the first connection via is disposed in the first end portion, and the second connection via is disposed in the second end portion.

14. The coil component according to claim 13, wherein the first and second connection vias are exposed from the first surface of the body to be spaced apart from each other.

15. The coil component according to claim 14, further comprising:

a first external electrode covering the first lead-out portion and the first connection via; and a second external electrode covering the second lead-out portion and the second connection via.

16. A coil component comprising:

a support substrate;

a first coil portion and a second coil portion, respectively arranged on the support substrate;

a body having a first surface and a second surface opposing each other in a thickness direction of the body, and embedding the support substrate and the first and second coil portions therein;

a first lead-out portion and a second lead-out portion, respectively connected to end portions of the first and second coil portions, the first and second lead-out portions being exposed from the first surface of the body to be spaced apart from each other in a length direction of the body; and a first connection portion and a second connection portion, respectively connecting the end portions of the first and second coil portions to the first and second lead-out portions, wherein each of the first and second coil portions has a constant line width ranging a respective end portion of the first and second coil portions, each end portion of the first and second coil portions is disposed in a first-half portion of the body, based on a central portion of the body in the thickness direction, each of the first and second connection portions has an outermost side surface and an innermost side surface, with respect to the length direction of the body, the innermost side surfaces of the first and second connection portions facing each other, and the outermost side surfaces of the first and second connection portions respectively facing side surfaces of the body, and a first acute angle defined by each outermost side surface of the first and second connection portions and the first surface of the body is smaller than a second acute angle defined by each innermost side surface of the first and second connection portions and the first surface of the body.

17. The coil component according to claim 16, wherein a line width of each of the first and second connection portions increases, as each of the first and second connection portions is closer to a respective one of the first and second lead-out portions from the respective end portion of each of the first and second coil portions.

18. The coil component according to claim 16, wherein the first and second lead-out portions each comprise at least one anchor portion extending in a direction toward an inner side of the body, and the at least one anchor portion of each of the first and second lead-out portions protrudes from a respective one of the first and second lead-out portions in the length direction of the body.

* * * * *